United States Patent [19]

Nicolls

[11] 4,272,940

[45] Jun. 16, 1981

[54] INTERLOCKING BUILDING BLOCK

[76] Inventor: Ted Nicolls, Rte. 2, Newcastle, Wyo. 82701

[21] Appl. No.: 18,169

[22] Filed: Mar. 7, 1979

[51] Int. Cl.[3] ..... E04B 2/18

[52] U.S. Cl. ..... 52/592

[58] Field of Search ..... 52/589–595, 52/286, 439, 259

[56] References Cited

U.S. PATENT DOCUMENTS

| | | | |
|---|---|---|---|
| 919,272 | 4/1909 | White | 52/286 X |
| 3,968,615 | 7/1976 | Ivany | 52/595 X |
| 4,075,808 | 2/1978 | Pearlman | 52/592 X |
| 4,115,980 | 9/1978 | Martel et al. | 52/591 |

FOREIGN PATENT DOCUMENTS

| | | | |
|---|---|---|---|
| 168413 | 6/1951 | Austria | 52/286 |
| 859943 | 12/1952 | Fed. Rep. of Germany | 52/286 |

*Primary Examiner*—J. Karl Bell

[57] ABSTRACT

A molded cement building block having horizontal and vertical pairs of tongue over groove configurations for interlocking with horizontally and vertically adjacent, similarly shaped blocks. The block is formed with two identically shaped side members integrally formed with a central member. A centrally disposed tongue extends longitudinally above the top surfaces of the side elements to form the vertical tongue and is recessed with respect to the bottom surfaces of the side members to form the vertical groove. The horizontal tongue and groove which interlock with adjacent blocks in a course are formed by the central member projecting at one end beyond the ends of the side members and being recessed with respect to the other ends of the side members to form respectively male and female ends in each block. The sides of both the horizontal and vertical tongue and grooves are mutually inclined to be self-guiding when the tongues are inserted into their associated grooves during the assembly of a structure with the blocks. A channel is formed along the top surface of the central member and openings are provided vertically through the central member for receiving horizontal and vertical reinforcing means, respectively.

9 Claims, 8 Drawing Figures

FIG.1
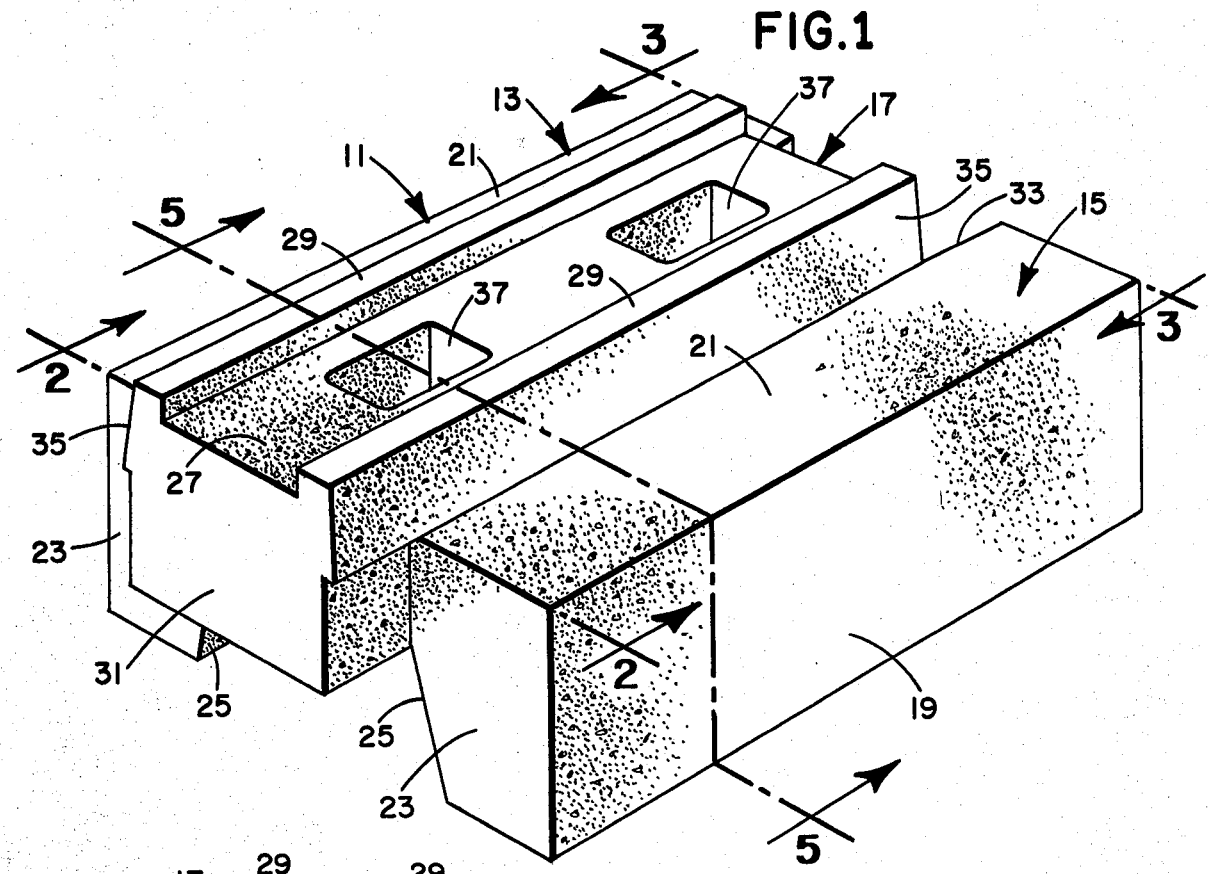
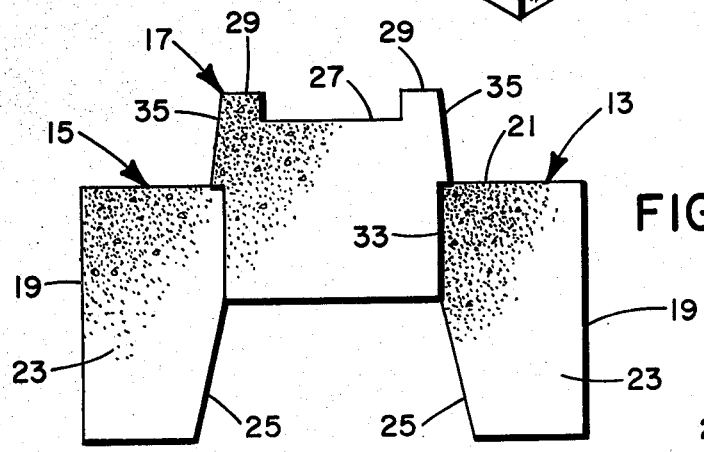
FIG. 2
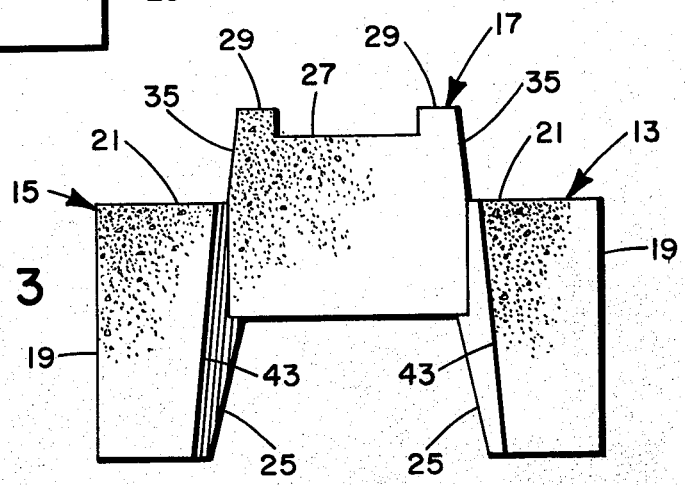
FIG. 3

INTERLOCKING BUILDING BLOCK

FIELD OF THE INVENTION

The invention relates with particularity to building blocks which include members for interlocking with similarly shaped blocks when the blocks are assembled into a structure.

BACKGROUND OF THE INVENTION

The building construction industry has employed interlocking, concrete building blocks for many years. Examples of such blocks can be seen in U.S. Pat. Nos. 1,434,612 to Hamilton; 1,499,493 to Simms; 2,351,768 to Kaping; 2,684,589 to Perreton; 2,887,869 to McKay; 3,376,682 to Briscoe; and 3,968,615 to Ivany.

The purposes of making building blocks interlocking include, inter alia, increasing the strengths of structures assembled with the blocks and decreasing the amount of skill required in building a structure with concrete blocks. By designing the block to increase the strength of the assembled structure, a builder or architect can achieve appreciable saving in the cost of materials. This results by reducing the requirement for expensive steel beam support members since the blocks themselves are capable of assuming increased amounts of the support function. By making the blocks interlock or interfit, the role which mortar plays in holding together horizontally and vertically adjacent blocks is also decreased and, thus, the need for skilled masons can oftentimes be eliminated. This enables less skilled workers to assemble a structure at a great savings in labor expense.

Although the prior art formed blocks represent strides in the art and have provided advantages over the commonly used rectangular shaped blocks the present invention provides advantages heretofore unknown in the art. A disadvantage of the known building block is the fact that the shapes thereof have caused the actual interfitting or interlocking portions to join in precisely and/or with difficulty. In most instances, the known interfitting construction blocks have increased the time required to assemble the blocks into a structure. Also, a number of the prior art blocks, when assembled, do not provide a flat interior and/or exterior walls. Still another disadvantage of the known blocks is that the interfitting portions of the blocks do not significantly add to the strength of a structure assembled therewith because the interfitting portions are too small and do not provide for even distribution of stress throughout all portions of the block. These and other shortcomings in the prior art blocks have demonstrated the need for an interfitting block which will overcome the existing problems.

SUMMARY OF THE INVENTION

It is an object of this invention to provide a cement or concrete building block which includes both horizontal and vertical tongue and groove elements for interfitting with similarly shaped blocks.

Another object of this invention is to provide an improved interfitting building block with tongue over groove configurations which include surfaces for guiding the tongue into the groove of vertically adjacent blocks and male and female portions for horizontal alignment.

It is a further object of this invention to provide an interfitting building block which distributes stress over a plurality of surfaces of the block.

Yet another object of this invention is to provide a molded building block with interfitting features which, when assembled with similar building blocks, provides a structurally strong assembly without the need for extensive supporting members.

A further object of this invention is to provide a molded, building block which can incorporate vertical and horizontal reinforcing bars into an integral structure.

These and additional objects of this invention are accomplished by a building block which can be easily formed by molding concrete or other suitable materials. The block when finished includes members for interlocking both horizontally and vertically with similarly shaped blocks to provide a strong assembly. The block is specifically designed to include guide surfaces to facilitate the joining of interfitting members as well as a plurality of surfaces for bearing stress in a distributed manner. The blocks when assembled provide flat side walls. The blocks also include channels and openings for receiving vertical and horizontal reinforcing means.

BRIEF DESCRIPTION OF THE DRAWINGS

While the scope of this invention is defined by the appended claims, a thorough understanding of the features and advantages thereof will best be understood by considering the following description in conjunction with the accompanying drawings wherein:

FIG. 1 is a perspective view of the block of the instant invention;

FIG. 2 is an end view of the block of FIG. 1 as seen along lines 2—2;

FIG. 3 is an end view of the block of FIG. 1 as seen along the lines 3—3;

DETAILED DESCRIPTION OF THE PREFERRED EMBODIMENT

Figure 4A:
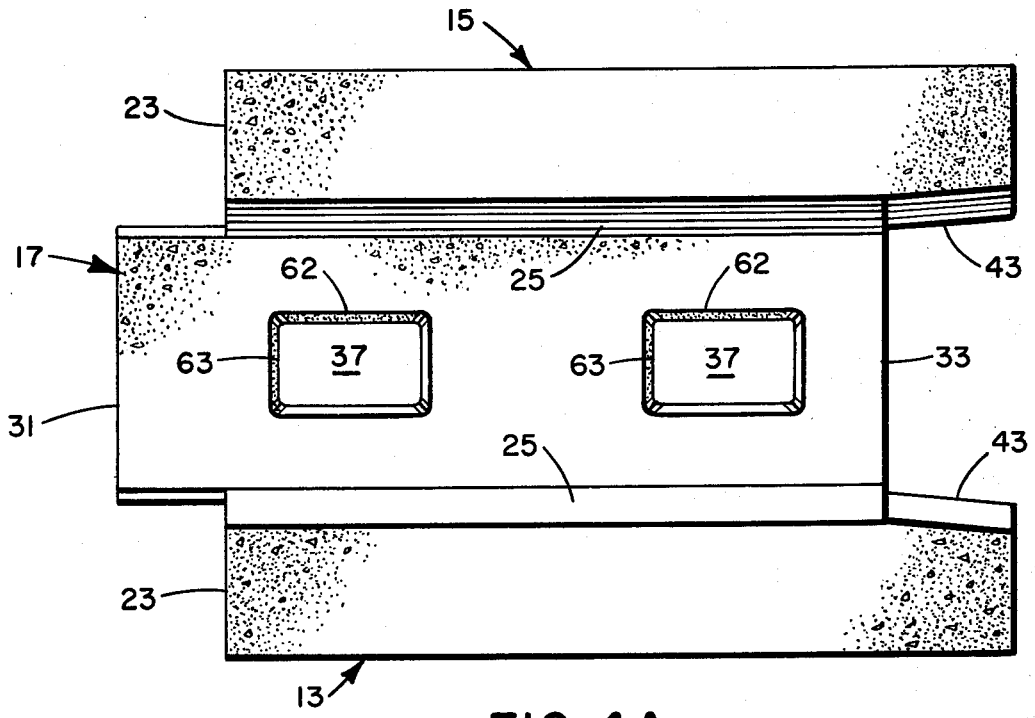
FIG. 4A is a view of the underside of the block of FIG. 1
Figure 4B:
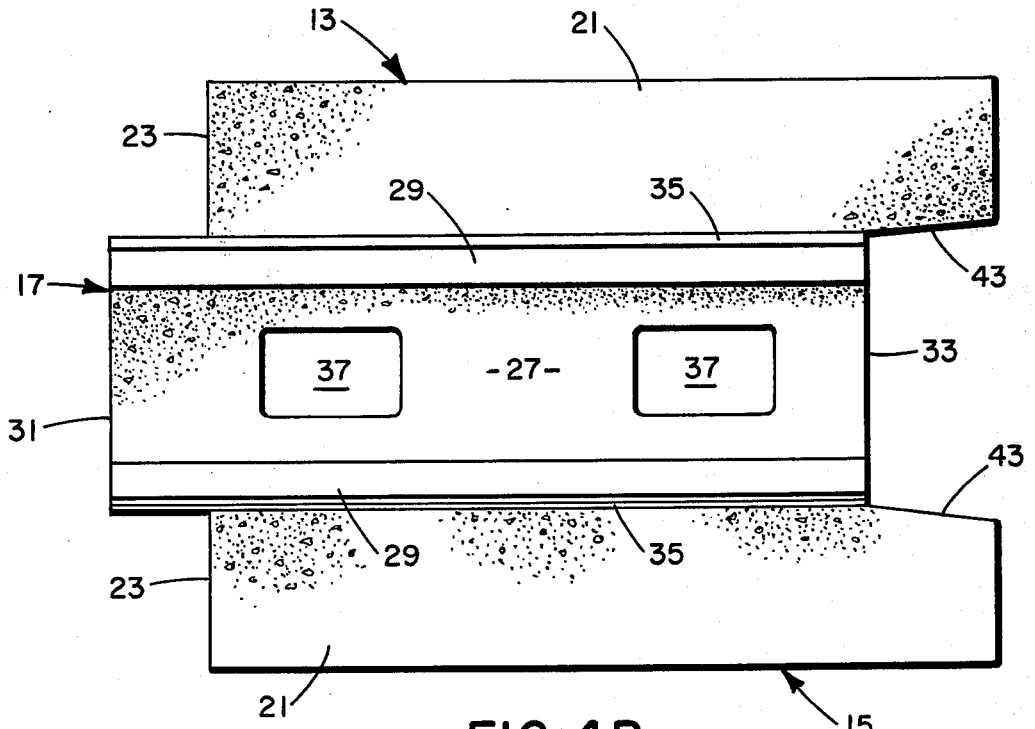
FIG. 4B is a view of the top surface of the block of FIG. 1.

The interlocking cement building block of the invention is advantageously used in constructing walls for buildings, retaining walls, and other structures where it is necessary and desirable to have great strength. The block is preferably made from a mixture of portland cement, sand and water, although other materials may be used to achieve the benefits of the invention. The blocks are simply fabricated by pouring the mixture into, for example, a right side up mold and pressing the mixture in the mold into shape with a hydraulic press. The block is removed when the material sets as in usual molding processes.

Referring to the drawings in which like parts have the same number, the block of the invention is generally shown in FIG. 1 as numeral 11. Block 11 comprises a pair of side body members 13 and 15 which are identical in shape and a centrally disposed body portion comprising a vertically extending tongue means 17. The central body portion is integrally formed with the side elements or members 13 and 15. In the illustrated embodiment, the exterior sides or surfaces 19 of elements 13 and 15 are depicted as vertically flat to the end that a flat wall will be provided when assembled with other blocks. It is to be understood however, that surfaces 19 may be provided with irregular configurations to obtain decorative effects. The top surfaces 21 of the side members 13 and 15 are flat and are adapted for receiving the bottom surfaces of a block stacked upon them. Surfaces 21 are one element of the invention which distinguish the inventive block from conventional blocks which normally require a single large surface area for mating with a block stacked upon it.

The ends 23 of side members 13 and 15 are flat and form right angles with surfaces 19 and 21. The interior surfaces 25 of side elements 13 and 15 are downwardly tapered from the juncture of surface 25 with the bottom of centrally disposed tongue means 17. In the preferred embodiment of the invention, the vertically extending tongue means 17 has inclined side walls 35 tapering from the widest portion at the juncture with the side members 13 and 15 to flat top surfaces 29. The tapered sides 35 of tongue means 17, serve as guides to facilitate the insertion of the tongue into a groove of a vertically adjacent block (shown in FIG. 7) formed by interior surfaces 25 and the bottom of the central body portion of tongue element 17.

A channel 27 extends longitudinally along the top surface of tongue member 17. Channel 27 is defined by side walls 35 having flat top surfaces 29. Surfaces 21 of the side members 13 and 15 and the flat top surfaces 29 of tongue side walls 35 distribute the stress of vertically stacked blocks.

Block 11 includes a male member 31 formed by an extension of the tongue element 17 beyond the ends 23 of side members 13 and 15. A female recess 33 generally of a depth approximating the length of the male member is formed in each block by extensions of side members 13 and 15 beyond the end of tongue means 17 opposite the end having male member 31. The central body portion of the block comprising tongue 17 is provided with one or more openings 37 therethrough which are designed to receive vertically placed reinforcing means 57 and mortar 60. The longitudinally disposed channel 27 when aligned with adjacently placed blocks form a continuous channel for receipt of longitudinally disposed reinforcing means 59 and mortar 60.

FIG. 2 is an end view of the male end of the block of the invention and shows both the tongue element 17 and the channel formed by the bottom surface of the central body portion and the inclined inner surfaces 25 of side elements 13 and 15. The respective inclines of inner surfaces 25 of side members 13 and 15 and the outer surfaces 35 of tongue 17 facilitate the insertion of a tongue into a groove of a vertically adjacent block when assembling the blocks into a structure.

FIG. 3 is a view of the female end of the block of the invention. As described hereinbefore the respective side members 13 and 15 extend beyond the end of the tongue member 17 whereby the female recess 33 is generally formed. The female recess 33 is vertically tapered by the inclined inner surface 25 of side members 13 and 15. Also, in the preferred embodiment, the recess is flared in such a manner that it is widest at its external orifice and narrower at the innermost portion of the recess limited by the end of tongue member 17. This construction enhances the horizontal alignment and interfitting of the male and female members of adjacent blocks when building a course or wall.

FIG. 4A is a bottom view of the block of FIG. 1. The tapered configuration of female recess can be seen at 43. Also, in the preferred embodiment, the openings 37 through the tongue means are tapered with the opening being wider at the bottom surface of the tongue 17 than at its top surface. The outer lines of openings 37 depicted in FIG. 2 as numeral 62 as shown at the openings 37 corresponds to the openings at the bottom of the tongue and the inner line 63 depicts the openings in the top surface of the tongue. The view of FIG. **4*b* is the topside of the block. The side walls 29 of the upper surface of the tongue can be seen defining the channel 27. The flared portion 43 of side members 13 and 15** of the female recess is also shown.

Figure 5:
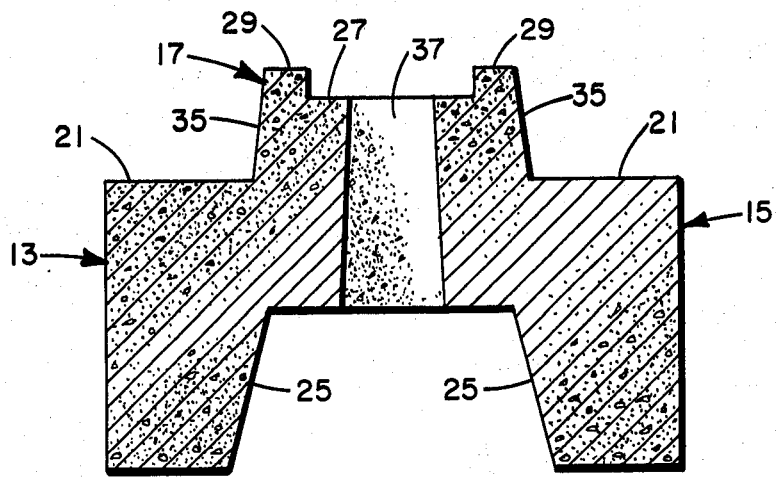
FIG. 5 is a cross-section view of the block of FIG. 1 taken along the lines 5—5.

FIG. 5 is a cross-sectional view of the block of FIG. 1 taken along the line 5—5'. This view shows the integral structure of the side members 13, 15 and the tongue 17. Also, the flare of a reinforcement opening 37 can be seen as it extends from the top surface of the central member to its bottom surface.

Figure 6:
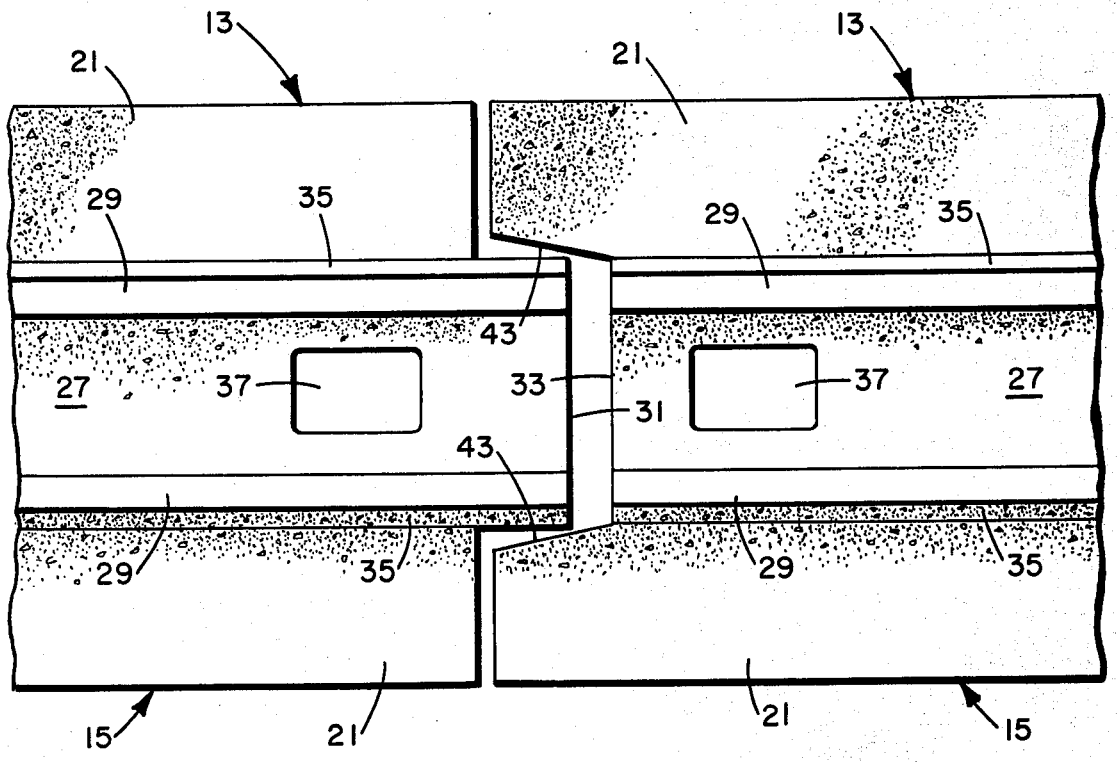
FIG. 6 is a top view of two blocks horizontally interlocked within a course.

The mating of the male member 31 of one block with the female recess 33 of another block is shown in the fragmentary top view of two blocks of FIG. 6. The inclined walls of the groove serve as guide surfaces for the male member as it is inserted into the female recess. This self-guiding structure simplifies and hastens the interfitting of the blocks in any given horizontal course.

Figure 7:
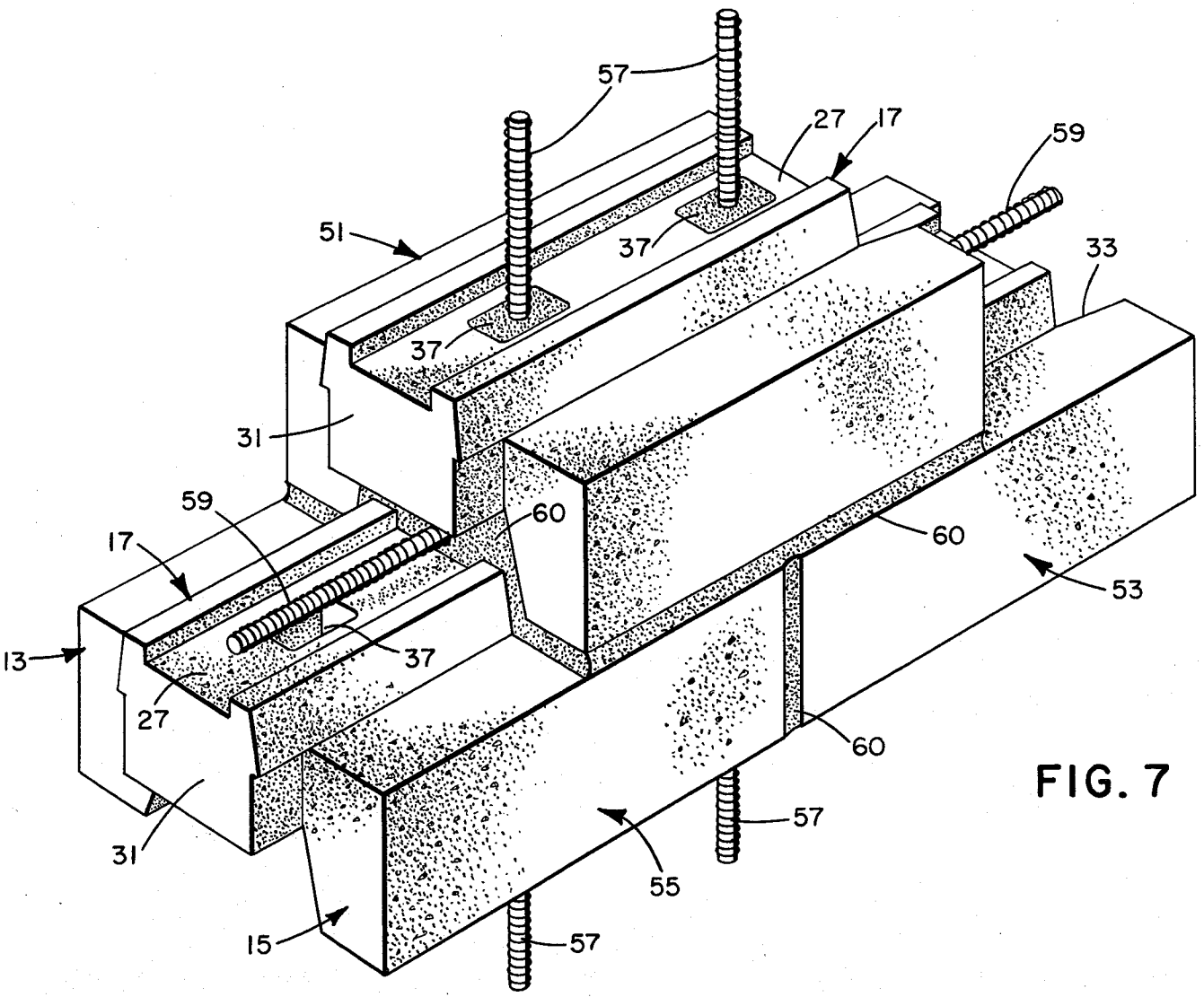
FIG. 7 is a perspective view of three blocks assembled together.

FIG. 7 depicts the assembly of three blocks 51, 53, 55. The longitudinal channels 27 of the blocks are shown with a horizontally disposed reinforcing rod 59 in place with mortar 60 in place between the blocks. The vertical openings 37 of the blocks are shown with vertical reinforcing rods 57 extending therethrough. This view also shows the plurality of load bearing surfaces evenly distribute stress with the walls. It can also be appreciated from the illustration of FIG. 7 that the tongue and groove means configuration of the invention facilitate the proper alignment of the blocks as they are vertically assembled while the male and female member configuration makes a course of blocks horizontally self-aligning, thereby providing a more integrally joined assembly of block than heretofore possible.

In summary, the building block of the invention provides a very strong structure when assembled with similar blocks. The simple and practical construction of the invention enables a wall to be built which is substantially horizontally and vertically self-aligning while providing a plurality of load bearing surfaces which evenly distribute stresses throughout the block.

The embodiment of the instant invention as described above is intended to be illustrative of a preferred embodiment. This embodiment is subject to certain modifications which would not depart from the spirit and scope of the invention as defined by the following claims.

What is claimed is:

1. A building block adapted to interfit with similarly shaped blocks when assembled into a structure, said block comprising: a central body portion and a pair of side body members disposed on either side of said central portion; vertically extending tongue means extending from the upper surface of said central body portion; groove means formed by the bottom of the central body portion and the inner surface of said side body member; a male member projecting from one end of said block; and a flared female recess means in the opposite end of said block for the receipt of the male member of an adjacent block, the interior surfaces of said side body members forming the interior walls of said female recess being horizontally tapered inwardly, said flared female recess being the widest at its external orifice and narrower at the innermost portion of the recess, whereby the horizontal alignment and interfitting of the male member and female recess of adjacent blocks is enhanced when building a course or wall.

2. The block of claim 1 further including a longitudinally disposed channel in the upper surface extending the length of said tongue means, said channel to be contiguous with the channel of horizontally adjacent blocks and adapted for the receipt of reinforcing means.

3. The building block of claim 1 wherein the interior surfaces of said groove forming side body members are tapered downwardly and outwardly from the lines formed by the intersection of the bottom of said central body portion with the interior surfaces of said side body members.

4. The building block of claim 2 wherein the exterior surfaces of said tongue means are tapered upwardly from the lines formed by intersection of the exterior surfaces of said tongue means and said side body members.

5. The block of claim 4 further including at least one vertical opening through said central body portion and tongue means for receiving vertically disposed reinforcing means.

6. The block of claim 5 wherein said vertical openings are larger at the top than at the bottom.

7. The block of claim 1 wherein the exterior vertical surfaces of said side members of said block are vertical planes.

8. The block of claim 7 wherein said central body portion, said tongue means and said side members include a plurality of load bearing surfaces for distributing stress across the upper surfaces of said block.

9. The building block of claim 1 wherein the interior surfaces of said side body members and the exterior surfaces of said tongue means are tapered and at such angles of inclination whereby the adjacent surfaces of mated tongue and grooves interfit in a generally parallel relationship.

* * * * *